United States Patent [19]

Zahedi et al.

[11] Patent Number: 4,505,723

[45] Date of Patent: Mar. 19, 1985

[54] FILTER APPARATUS

[75] Inventors: Karim Zahedi, Newton; Jeffrey C. Alexander, Essex; Peter B. Zieve, Arlington, all of Mass.

[73] Assignee: EFB Inc., Woburn, Mass.

[21] Appl. No.: 507,947

[22] Filed: Jun. 24, 1983

Related U.S. Application Data

[63] Continuation of Ser. No. 312,962, Oct. 20, 1981, abandoned.

[51] Int. Cl.[3] ..... B03C 3/74

[52] U.S. Cl. ..... 55/117; 55/120; 55/131; 55/138; 55/146; 55/149; 55/479; 361/230

[58] Field of Search ..... 55/149, 117, 120, 150–152, 55/131, 138, 146, 479; 361/225–235

[56] References Cited

U.S. PATENT DOCUMENTS

| | | | |
|---|---|---|---|
| 1,984,159 | 12/1934 | Scwedenberg et al. | 361/231 |
| 2,252,694 | 8/1941 | Bennett | 55/151 |
| 2,667,942 | 2/1954 | Wintermate | 55/152 |
| 3,440,800 | 4/1969 | Messen-Jaschin | 55/149 |
| 3,611,337 | 10/1971 | Balzer et al. | 55/274 |
| 3,917,458 | 7/1972 | Polak | 55/99 |
| 3,926,587 | 12/1975 | Squires | 55/12 |
| 4,004,350 | 1/1977 | Squires | 34/33 |
| 4,093,430 | 6/1978 | Schwab et al. | 55/150 |
| 4,093,432 | 6/1978 | Ahlrich | 55/149 |
| 4,126,435 | 11/1978 | Reese | 55/474 |
| 4,142,873 | 3/1979 | Berz | 55/12 |
| 4,144,359 | 3/1979 | Zahedi et al. | 55/131 |
| 4,149,858 | 4/1979 | Noack et al. | 55/73 |
| 4,247,307 | 1/1981 | Chang | 55/152 |
| 4,248,612 | 3/1981 | Wakabayashi et al. | 55/350 |
| 4,255,166 | 3/1981 | Gernand et al. | 55/3 |
| 4,294,591 | 10/1981 | Kahl | 55/120 |
| 4,308,036 | 12/1981 | Zahedi et al. | 55/131 |
| 4,338,113 | 7/1982 | Hohman et al. | 55/131 |
| 4,406,672 | 9/1983 | Berz | 55/131 |

FOREIGN PATENT DOCUMENTS

| | | | |
|---|---|---|---|
| 0035973 | 9/1981 | European Pat. Off. | 55/131 |
| 858692 | 12/1952 | Fed. Rep. of Germany | 55/152 |
| 2400941 | 4/1979 | France . | |
| 86512 | 6/1980 | Japan | 55/479 |
| 55920 | 2/1913 | Switzerland | 55/479 |
| 2036604A | 7/1980 | United Kingdom . | |
| 639579 | 12/1978 | U.S.S.R. | 55/474 |

*Primary Examiner*—Bernard Nozick

*Attorney, Agent, or Firm*—Shapiro and Shapiro

[57] ABSTRACT

Electrified filter bed apparatus includes inner and outer cylindrical bed-retaining structures for confining a granular bed therebetween. The inner cylindrical structure may comprise a cage of superposed frusto-conical louvers and the outer structure may comprise a similar cage or a perforated cylindrical, liquid-drainage sheet. A cylindrical bed electrode for electrically charging the bed granules is suspended between the retaining structures. The tubular bed surrounds an internal gas passage from which polluted gas flows through the bed from the inside out. Gas enters the internal passage from above through an ionizer section of the apparatus. The ionizer section may include a disc-type ionizer assembly in an ionizer tube. The tube may form an extension of the inner louver cage. A corona discharge may be formed between the disc and the ionizer tube by providing electric current to the discs, whereby the corona discharge electrically charges particulate material within the gas stream. The discs may carry radially protruding needles defining circumferential corona discharge points. A blowdown system may be provided for cleaning the ionizer discs and the tube wall in the region of the discs. The apparatus may include means for avoiding blowout of bed granules from between the outer louvers, and a system for washing pollutant-coated bed granules.

18 Claims, 8 Drawing Figures

FILTER APPARATUS

This application is a continuation of Ser. No. 312,962, filed Oct. 20, 1981, now abandoned.

BACKGROUND OF THE INVENTION

This invention relates to filter apparatus useful for removing fine (submicron) particulate material from a stream of air or other gas, the particulate material being in solid or liquid form. More particularly, the invention relates to filter apparatus of the type in which pollutant particles in a gas stream are given an electrical charge and the charged stream is then passed through a granular filter bed in which the bed granules are polarized by the application of an electric field to the bed. The polarized granules attract and retain the charged particulate material so that it is separated from the gas stream. An electrical charge may, for example, be applied to the particulate material prior to passage through the filter bed, by passing the polluted stream through an ionizer, where it is subjected to a high voltage corona discharge. Electrification of the bed granules may be achieved by producing an electric field between a high voltage electrode immersed in the bed and a grounded bed-retaining structure.

Filter apparatus of the above type may for convenience be referred to as electrified filter bed apparatus, and its technology is well developed. The apparatus exhibits advantages compared with other forms of electrical filtering apparatus; for example, due to the use of a granular filter bed, the apparatus can provide a large collection surface area in a small volume. (Filtering efficiency is related to the available collection area.) Further, in the subject apparatus, the collection surface may be an inexpensive durable material, such as gravel, which gives the apparatus cost advantages.

Copending U.S. patent application Ser. No. 69,046 filed Aug. 23, 1979, U.S. Pat. No. 4,308,036, the subject matter of which is incorporated herein by reference, discloses electrified filter bed apparatus of the above type. The prior application relates, inter alia, to the concept of causing the granular bed to move downwardly as a rigidified plug during passage of polluted gas therethrough by applying an electric field to the bed of suitably high intensity. This is found to improve the filtering efficiency by trapping the particulate material in the bed granules. The prior application also discloses other concepts relating to the design and operation of electrified filter bed apparatus.

SUMMARY OF THE INVENTION

The present invention pertains to varous aspects of electrified filter bed technology directed toward optimizing the efficiency of the apparatus consistent with economizing in its construction and operation.

In one of its aspects, for example, the invention provides electrified filter bed apparatus, in which the bed is of tubular form surrounding a central gas passage which polluted gas enters from above for outward flow through the bed. An ionizer for electrically charging pollutant particles in the gas comprises an ionizer tube forming an upward extension of the passage and an ionizer assembly within the tube, the gas flowing through the tube before entering the passage.

In another of its aspects, the invention provides electrified filter bed apparatus wherein an ionizer for electrically charging particulate material in a polluted gas stream, prior to passage of the stream through an electrified granular bed, comprises a circular disc positioned concentrically in a tube through which the polluted gas stream flows, the disc being held at high voltage while the tube is grounded, to create a corona discharge in the tube. The ionizer may include a plurality of axially spaced discs, and the discs may carry sharp radially-extending needles, with the needle tips projecting from the disc edge to provide sharp corona discharge points.

Other aspects of the invention include, for example, a form of construction of inner and outer louver cages, between which the electrified filter bed granules may be accommodated; a method and means for preventing blowout of the bed granules from between the louvers; ionizer cleaning arrangements; a form of electrified filter bed apparatus which is particularly adapted to promote liquid drainage so as to be useful in the filtering of gas streams that include pollutants in the form of fine liquid mists; and a granule cleaning system for pollutant-coated bed granules.

The above and other aspects of the invention will become more readily apparent from the ensuing description and claims taken in conjunction with the accompanying drawings.

DESCRIPTION OF PREFERRED EMBODIMENTS

Figure 1:
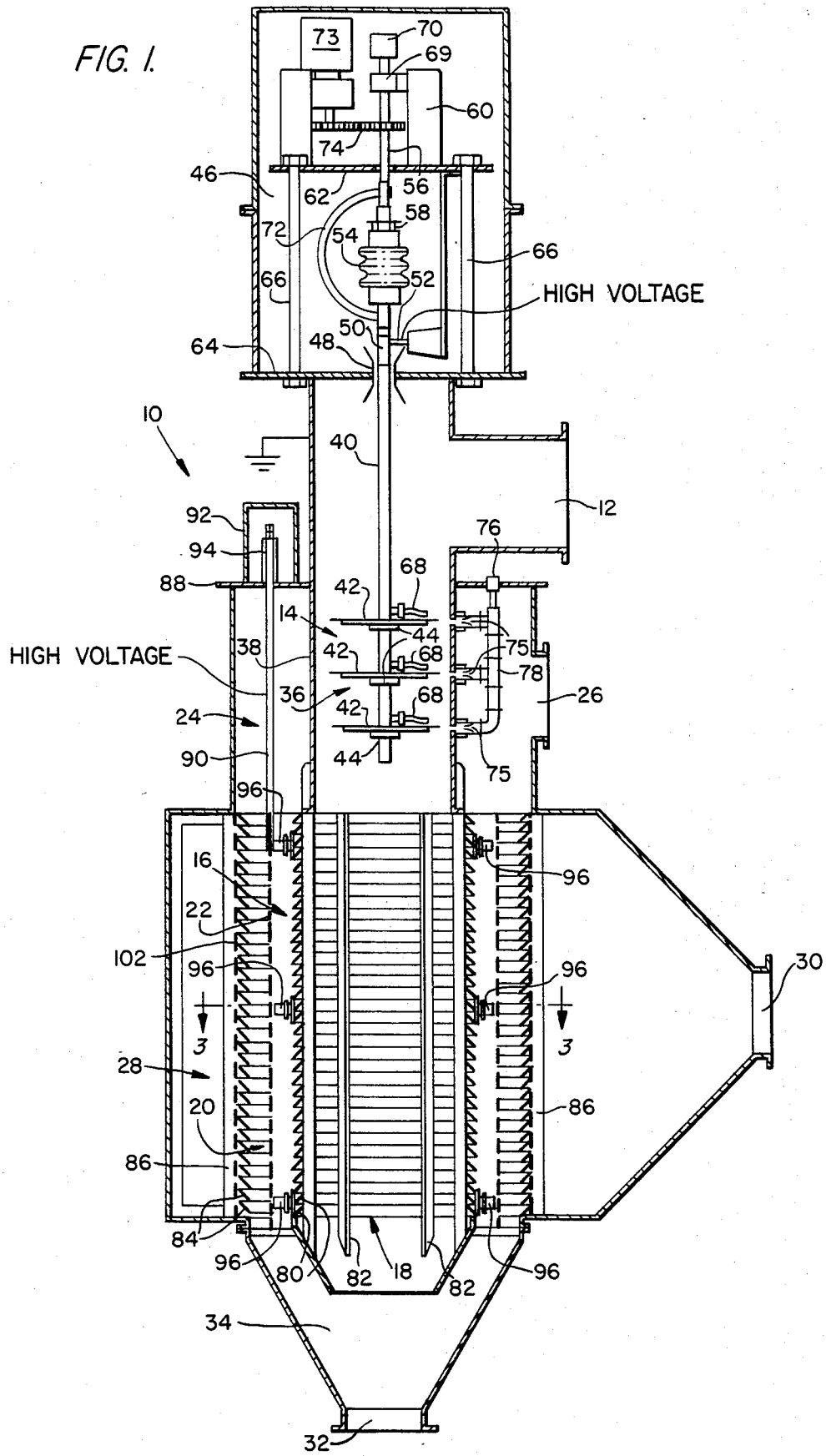
FIG. 1 is a sectional elevational view of one form of electrified filter bed apparatus in accordance with the invention.
Figure 2:
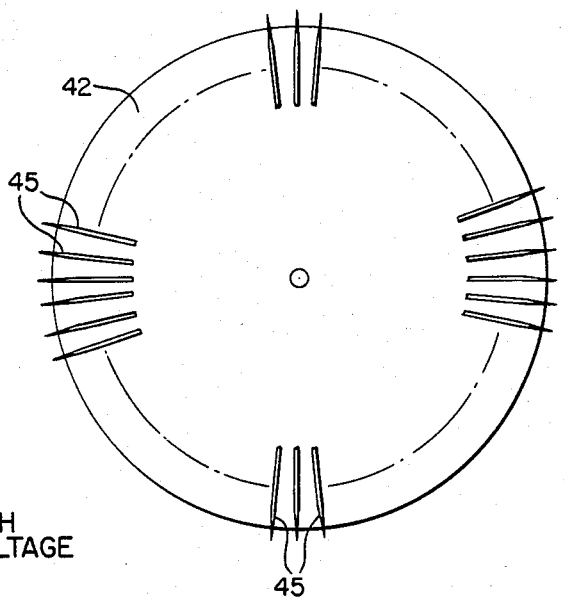
FIG. 2 is a plan view of an ionizer disc used in the FIG. 1 apparatus.
Figure 3:
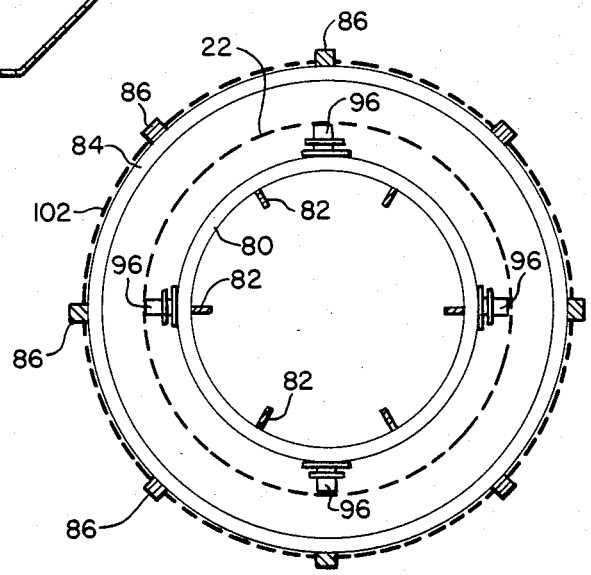
FIG. 3 is a sectional view on line 3—3 of FIG. 1.

FIGS. 1-3 show an electrified filter bed apparatus 10 suitable, for example, for filtering dry dust-type pollutants from a gas stream, which may be at a relatively high temperature, i.e., of the order of 200° F. or higher.

In the illustrated embodiment, polluted, dustladen gas, for example, is adapted to enter the apparatus through a gas inlet 12, flow through an ionizer section of the appartus 14, where the dust particles in the gas become electrically charged, the gas then entering a filtering section of the apparatus 16, for radially outward flow through a filter bed of tubular form. The filtering section includes, inter alia, an inner cylindrical louver cage 18 and an outer cylindrical louver cage 20, between which the bed granules are accommodated. The louver cages accordingly form inner and outer bed-retaining structures which confine the tubular granular bed therebetween. A cylindrical bed electrode 22 is located between the louver cages. Granules may be admitted to the space between the louver cages from a charging section of the apparatus 24, the granules being admitted, for example, through charging ports (not shown) in a top flange 88. An inspection port 26 may also be provided in the charging section. The interior of the inner louver cage forms an internal gas passage surrounded by the tubular bed, which gas passage receives polluted gas from the ionizer section of the apparatus.

In operation of the apparatus, a polluted gas stream flows downwardly into the internal gas passage in the filtering section 16, and then radially outwardly through the louver cages and filter bed. The bed granules are polarized by the creation of an electric field between electrode 22 and the louver cages which are grounded. Thus, the granules attract the charged dust particles in the gas stream, so that the stream is filtered as it passes through the bed. From a gas outlet plenum 28, the filtered gas is discharged from the apparatus through an outlet 30. The bed granules may be allowed to move continuously downwardly under gravity during the filtering process, and be discharged, for example, through a port 32 at the base of a granule outlet hopper 34. After suitable cleaning of the discharged granules, for example, pneumatically, they may be recycled through the apparatus, the rate of granule movement being controlled by a granule feeder, for example.

The downward, inside-to-out gas flow path of the present apparatus offers advantages when used with a downwardly moving bed. In this type of unit, gas flow distribution is non-uniform in the vertical direction due to gas inertia as it enters the filtering section of the apparatus. This effect would tend to cause gas flow to be higher at the base of the bed than at the top. With a downwardly moving bed, however, the lower bed portions become more loaded with filtered-out dust than the upper portions, and consequently more resistant to gas flow. Thus, with downward, inside-to-out gas flow, and downward bed motion, the effects of gas inertia and bed loading can be made to counterbalance each other and provide a more uniform gas flow distribution in the vertical direction, as will be described.

Specific features of the apparatus will now be described in more detail.

Considering initially the ionizer section 14 of the apparatus, it will be noted that this includes an ionizer assembly 36 suspended in a grounded metal tube 38 through which the polluted gas stream passes. Ionizer assembly 36 comprises a hollow metal shaft 40 on which are mounted three axially spaced ionizer discs 42. The discs may be secured to collars 44 carried on the shaft. Each disc (see FIG. 2) carries a series of radially extending needles 45 arranged so that their sharp ends protrude from the edge of the disc. The discs may be made of metal and the needles (which may be of a type known for use in corona discharge apparatus), may be spot-welded in place, for example.

The spacing between the tips of adjacent needles may be in the range of ½ inch to 3 inches and the gap between the needle tips and tube 38 may be in the range of 1–6 inches. In use, when a high voltage (which may be negative DC relative to ground of the order of 25–75 kv) is applied to the discs, through shaft 40, as will be described, a corona discharge takes place at each needle point creating ions which migrate towards tube 38. Hence, as the polluted gas stream flows through the tube, the ions attach to pollutant particles in the stream and the particles become electrically charged. It is preferred to use a needle disc in place of a plain disc with a sharpened edge (which could also be used), since with a needle disc the corona discharge is localized and intensified at the needle tips. Also, a needle disc has a lower corona turn-on voltage so that the operating voltage band is wider than that of a plain disc. To ensure efficient electrical charging of the pollutant particles in the gas stream, the needles may be staggered disc-to-disc, so as to provide irregular non-overlapping corona discharge patterns. While the drawings show an ionizer having three discs, the number may be varied to suit individual applications. At least two and preferably three discs should be used. Experiments have shown that typically about 5 to 10% of the particulate can pass through a single ionizer gap without being charged. Using three discs, the fraction of uncharged particulate is found to be reduced to about 0.0125 to 0.1%.

The ionizer assembly is suspended by shaft 40 from a mounting arrangement housed in a compartment 46 at the top of the apparatus. An air gap 48 is provided around shaft 40 and compartment 46 is maintained at a higher pressure than ionizer section 14 so as to ensure that purge air flows from compartment 46 into the ionizer section, preventing polluted gas from entering the compartment and providing insulation around shaft 40. To provide the required pressure differential, compartment 46 may, for example, be maintained at atmospheric pressure, while the pressure in the ionizer section is sub-atmospheric, since the polluted gas is drawn through the apparatus, for example, by a fan associated with, or downstream of, the gas outlet 30.

At its upper end, shaft 40 is provided with a slip-ring 50, through which high voltage for the ionizer disc may be supplied by a contact 52 leading from a suitable electrical source. Shaft 40 is connected to a ceramic insulator 54 which is in turn connected to a hollow drive shaft 56 by an adjustable connection 58 which permits the shaft to be properly aligned. The connection may, for example, comprise a pair of plates connected to the respective shafts, with bolt and nut connectors therebetween, allowing the relative inclination of the plates, and hence the alignment of the shafts to be adjusted.

Shaft 56 is suspended from a bearing 69 associated with a pedestal 60 mounted on a plate 62. Plate 62 is supported from base wall 64 of compartment 46 by rods 66 which are screw-adjustable, so that the inclination of plate 62 can be varied. This allows the ionizer discs to be accurately centered and aligned relative to tube 38.

Charged dust particles and the like may tend to build up on the ionizer discs and on the walls of tube 38 in the region of the discs, thereby adversely affecting the creation of an adequate discharge. In the present apparatus, a wall and disc blowdown system is incorporated for periodically cleaning these areas with compressed air. To this end, shaft 40 carries a number of air nozzles 68 directed against the relevant wall areas of tube 38. The nozzles communicate with the interior of shaft 40 and may, for example, receive compressed air through an air inlet 70, the interior of shaft 56, and a connecting hose 72. In order that the nozzles may sweep the entire circumference of the tube 38, the entire ionizer assembly may be rotated by means of a drive motor 73 and a reduction gear train 74 which drives the ionizer assembly at a low speed, of the order of 1 rpm.

Stationary blowdown nozzles 75 may be provided in the wall of tube 38 to clean the respective ionizer discs, these nozzles being supplied with compressed air from an air inlet 76 and a header 78. The nozzles 68 and 75 may be operated periodically, as required in a particular application, to clean the tube and discs, respectively.

The frequency of operation will depend on the propensity of the apparatus to collect dust and may vary from about 12 times an hour to once a day. Generally, each of the sets of nozzles 68 and 75 may be operated for a single revolution of the ionizer assembly.

As an alternative to the blowdown system, a mechanical cleaning system using brushes or the like, may be employed for cleaning the ionizer discs and tube.

The inner louver cage 18 may conveniently be formed by welding individual louvers 80 to the outside of a plurality of vertical support bars 82. The louvers have a frusto-conical shape, with a cone angle of about 60°. It has been found that if the louver height is of the order of 3–4 inches and the thickness of the order of ¼ inch to 5/16 inch, the louvers can be formed by suitably rolling a flat, linear metal strip of the correct dimensions. In this process, the strip is first edge-rolled in the plane of the strip, to a 180° arc, in a suitable rolling mill (a number of passes may be required to roll the flat strip edgewise into an arc). Then, the arcuate strip is cone-rolled to a complete 360° ring of tighter radius at the required cone angle. This process economizes in metal usage compared with processes in which louvers are cut into arcuate shapes from metal sheet.

The spacing between the individual louvers of the cage is dependent on the angle of repose of the bed granules (see the previously referred-to patent application for greater detail), while allowing a small amount of overlap. For 3-inch louvers, the spacing may, for example, be about 2.35 inches.

The outer louver cage may be constructed in a similar manner to the inner cage, except that the louvers 84 are reversed with respect to the inner louvers and may be welded to the inside of vertical support columns 86. Similar size and space considerations apply to the inner and outer louvers, with the outer louvers being formed from longer metal strips and being rolled to a larger diameter than the inner louvers.

The cylindrical or tubular configuration of the apparatus allows for a simple form of assembly procedure. The inner louver cage 18 and ionizer tube 38 may conveniently be fabricated as a single unit incorporating a flange 88. (Preferably, the diameters of the inner louver cage and ionizer tube are substantially equal for reasons yet to be explained.) Bed electrode screen 22 conveniently may be suspended from flange 88 by three circumferentially spaced hanger rods 90 (only one is shown in FIG. 1) supported from insulator housings 92. The rods, which may be sleeved with an electrically insulating tube that may be alumina, may be suspended in sleeves 94 and releasably held in place by any suitable suspension means, e.g., upper end nuts and washers. One of the three rods may be used to provide high voltage (AC or DC, of the order of 2–20 kv) to the bed electrode. The supplied voltage may be sufficient to produce a field intensity which causes "freezing" of the downwardly moving bed granules as described in the previously referred-to patent application.

Inner louver cage 18 and bed electrode 22 may be maintained in properly spaced and centered relationship by spacer-insulators 96 which may be of ceramic material, connected to plates welded to the inner louver cage.

Fabrication of the apparatus core (inner louver cage, ionizer tube, and suspended bed electrode) in the manner described, facilitates assembly of the core itself, by suspension of the electrode screen from flange 88, and also facilitates assembly of the core in the outer housing comprising the outer louver cage, plenum chamber 28 and bed outlet hopper 32. Further, with this arrangement, all the electrical insulators are mounted on the core, so as to be readily accessible for repair or replacement. Use of the insulating spacers 96 alleviates the need for excessive reinforcement of the electrode support structure in order to withstand lateral loads applied by the moving granular bed.

The relative sizes of the various apparatus components are of relevance. It has, for example, been found, in order to comply with size, weight, cost and operating pressure drop considerations, that the depth of the granular bed (radially) should preferably be of the order of 4 inches to 12 inches, with a granule size of the order of ⅛ inch to ⅜ inch in cross dimension. When gravel is used, this may, for example, be screened between 3 and 10 mesh. It has been found that the diameter of the inner louver should be of the order of 1.5 to 3 feet, and this limits the overall size of the apparatus. Further, this diameter substantially corresponds to the diameter required for the ionizer tube, to give optimum pollutant charging efficiency consistent with pressure drop across the ionizer. The matching of diameters of the ionizer tube and inner louver cage, further facilitates manufacture of the unit and reduces manufacturing costs. Units built to the optimum dimensions may handle up to about 13,000 cfm. of gas flow.

Figure 7:
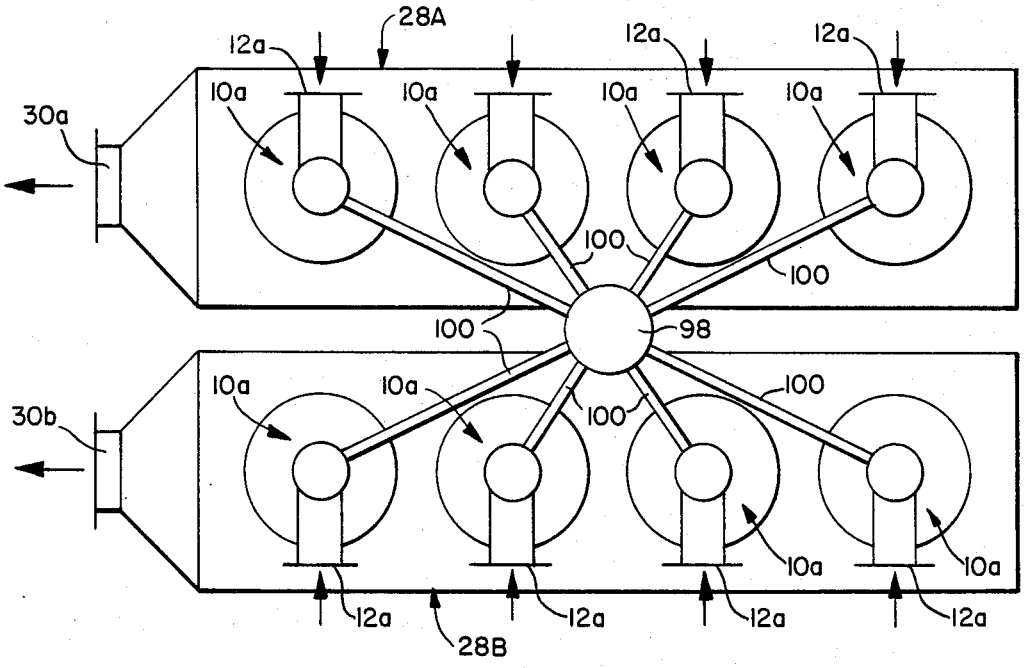
FIG. 7 is a partly diagrammatic view of still another form of electrified filter bed apparatus in accordance with the invention, having a plurality of filter units.

For applications where quantities of gas need to be accommodated that exceed the quantity which can be handled by an optimum size unit, it is expedient to group a batch of optimum size units in a common gas outlet plenum. As shown semi-diagrammatically in FIG. 7, for example, two banks, each having four filter units 10*a* are grouped in common gas outlet plenums 28A and 28B. Each filter unit has an individual inlet 12*a* for polluted gas and ionizer and filtering sections as previously described. Individual units receive bed granules from a common supply 98 through feed pipes 100. Granules are returned to the common supply on discharge from the individual units and after cleaning. Filtered gas is discharged through gas outlets 30*a* and 30*b*.

Use of an outer louver structure for the prevention of plugging on the outlet side of the granular bed introduces a possible operational problem termed "blowout". If gas velocity through the bed becomes excessive, granules can be lifted out of the outer louvers and blown out of the bed. For ⅛ inch to ¼ inch granules, blowout can occur at an equivalent face velocity of 150 feet per minute. As the bed loads with dust, the blowout velocity may be decreased. It is found that failures in ancillary systems, such as the gravel-moving or cleaning systems, may create excessive pressure drops across the bed, leading to blowout. Typically, for the granule size previously mentioned, a suitable operational gas pressure drop across the bed may be of the order of 3 to 4 inches wg. Blowouts have been found to occur when the pressure drop reaches a value of about 9 inches wg.

In accordance with an aspect of the invention, therefore, in order to reduce the risk of blowout, the pressure drop across the bed may be constantly monitored, using conventional pressure-measuring equipment, for example, to measure gas pressure on opposite sides of the bed. A warning function, such as an alarm, may, for example, be automatically sounded if the pressure drop attains a predetermined threshold value (e.g., 6 inches wg.) less than the value at which blowouts occur. The apparatus may then be inspected and the relevant fault corrected before the occurrence of a blowout.

An additional means in accordance with the invention for avoiding blowouts, involves the use of a retaining screen 102 (see FIGS. 1 and 3) on the outer face of outer louver cage 20. As seen in FIG. 3, screen 102 is segmented to fit between columns 86 and is substantially contiguous with the outer edges of louvers 84. The screen should have perforations sufficiently small to prevent passage therethrough of the bed granules. To prevent long-term fouling of the screen with dust, it is preferred to use the maximum size opening which just prevents such passage (an opening in which the minor dimension approaches the cross dimension of the smallest bed granules). For bed granules of ⅛ inch diameter, for example, a screen having horizontal slots of 1 inch by ⅛ inch has been found to be suitable.

Under normal operation of the apparatus, the bed granules do not contact the retaining screen. In the event of circumstances sufficient to promote a blowout, however, granules are blown against the screen and since they cannot penetrate the screen, the granules tend to fill the normally void regions between the louvers and the screen. When the blowout conditions have been detected, and the apparatus shut down, the bed can be returned to its normal condition by running the granule recirculation system.

Where a retaining screen is used in conjunction with a pressure drop signalling system as described above, a system results in which blowout will not occur except possibly in a case of extreme operator negligence, and even in such a case, the apparatus can be restored to normal operation by a simple procedure.

Figure 4:
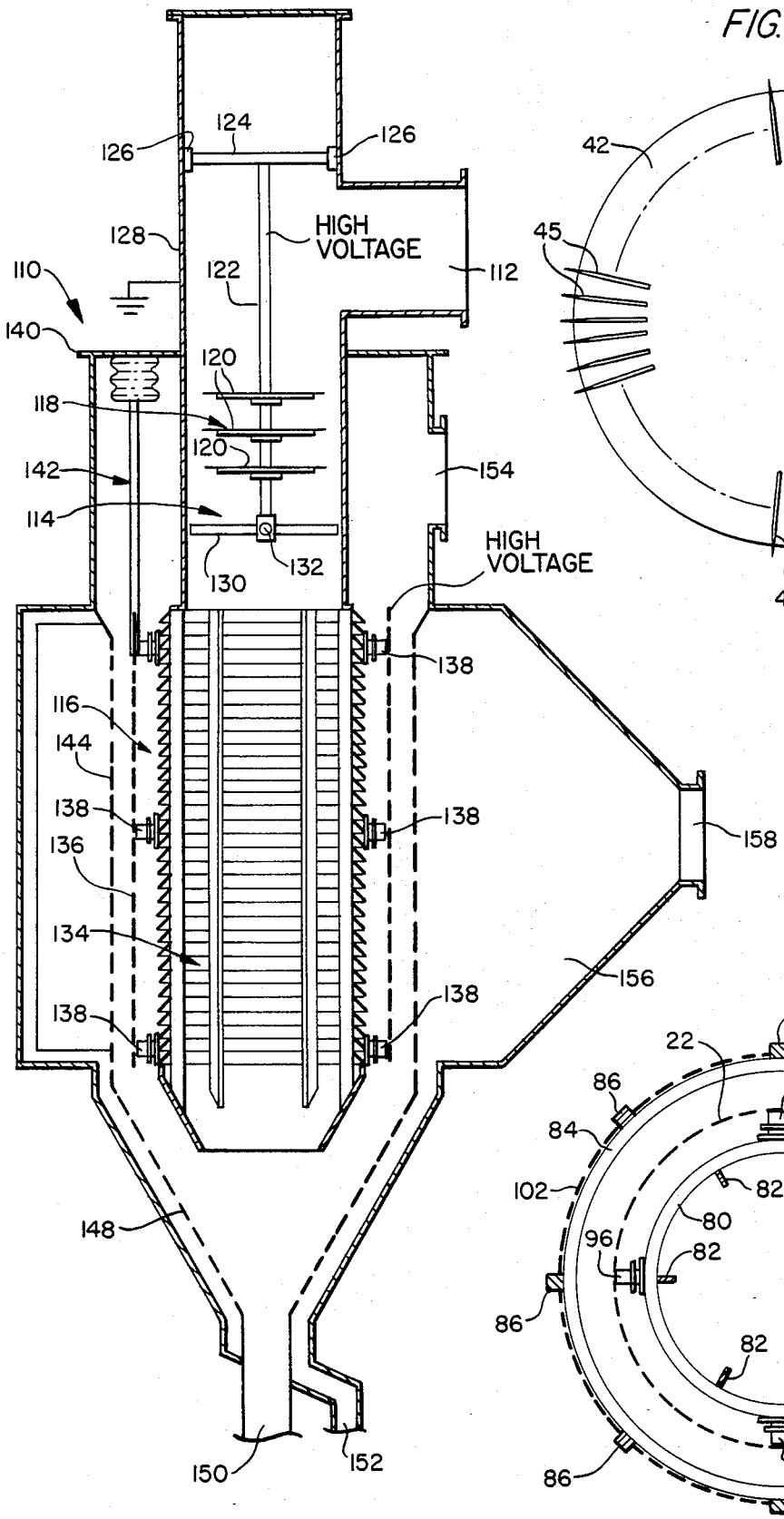
FIG. 4 is a sectional elevational view of another form of electrified filter bed apparatus in accordance with the invention.
Figure 5:
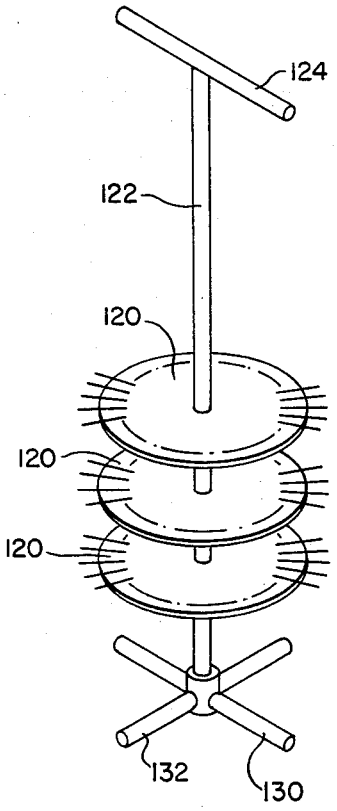
FIG. 5 is a perspective view of an ionizer assembly used in the FIG. 4 apparatus.
Figure 6:
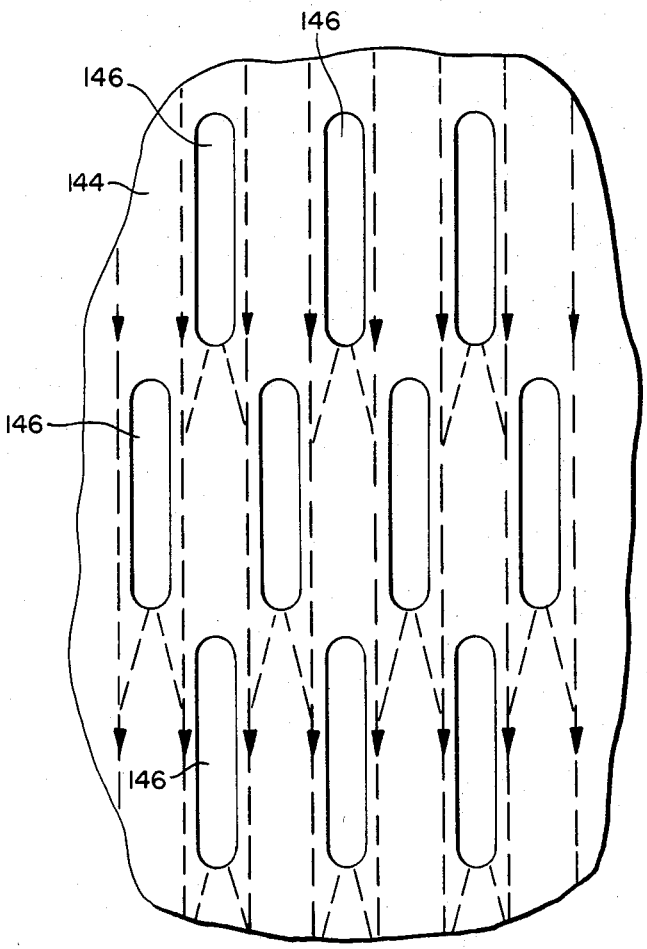
FIG. 6 is a detailed view of part of a liquid-drainage screen used in the FIG. 4 apparatus.

FIGS. 4 to 6 illustrate a second form of apparatus 110 in accordance with the invention, suitable, for example, for filtering gas streams containing pollutants in the form of a liquid mist.

As in the previous embodiment, polluted gas is adapted to enter the apparatus through a gas inlet 112, flow through an ionizer section 114, where the mist particles in the stream are electrically charged, the gas stream then entering a filter section 116 of the apparatus through an inner gas passage, for radially outward flow through a tubular granular bed.

Ionizer section 114 includes a multi-disc ionizer assembly 118 comprising three axially spaced needle discs 120 as previously described, carried on a conducting rod 122. The assembly has an upper insulating hanger rod 124 mounted in brackets 126 in ionizer tube 128, and lower insulating rods 130, 132 which center the assembly in the tube. High voltage electric current, for providing a corona discharge at the needle points, may be supplied to rod 122 by any known means, not shown. Ionizer blowdown nozzles, as previously described, may be omitted in apparatus for filtering liquid mists and the like, where there is no tendency for pollutants to accumulate one the ionizer discs and the tube. Alternatively, in applications where cleaning is required, the nozzle system may be used to supply a solvent cleaning solution.

Filtering section 116 includes an inner louver cage 134, a perforated cylindrical bed electrode 136, and insulating spacers 138, all as previously described. The louver cage, ionizer tube 128, and flange 140, may again be fabricated as a single unit defining the inner core of the apparatus. Bed electrode 136 is, in this embodiment, suspended from flange 140 by three circumferentially spaced rod and insulator assemblies 142. A conductor rod (not shown) may again provide electrical current for the bed electrode.

In place of the outer louver cage of the previous embodiment, the present apparatus has a perforated tubular metal sheet 144 defining the outer margin for the granular bed. For liquid mist applications, where the filtered liquid tends to accumulate at the outer face of the granular bed, a louver structure provides no means for the liquid to drain, and hence the provision of sheet 144, which promotes drainage of the filtered mist. Preferably, sheet 144 has a pattern of staggered, vertically disposed slots 146, as shown in FIG. 6. It is found that this slot pattern produces drainage paths for the collected pollutant along the outer surface of sheet 144, as indicated by the dotted lines in FIG. 6.

The apparatus may be operated for liquid drainage, with the granular bed stationary, since there is minimum tendency for the bed to become plugged with pollutant (it may, however, be moved periodically, e.g., for cleaning purposes or to minimize any tendency of the bed to clog). Flow of the polluted gas stream from the bed from the inside out, causes the liquid pollutant to collect at the base of the slots 146. Liquid is drawn by the gas flow through the slots, coalesces with other liquid on the outer surface of sheet 144 and flows down the indicated paths. It is preferable with this arrangement to limit the gas flow velocity to about 100 feet per minute, to prevent re-entrainment of liquid droplets in the gas stream.

The base of the apparatus includes a drainage structure in the form of a tapering perforated plate 148, which is a continuation of sheet 144. Internally, plate 148 defines a hopper outlet for bed granules and externally it provides a liquid drainage space. Bed granules may be discharged through outlet 150 and liquid may drain through outlet 152. Plate 148 may have slots of similar configuration to the slots in sheet 144, but the pattern is not critical, since there is essentially no gas flow through the plate. The apparatus has gravel inlets, an inspection port 154, a gas outlet plenum 156, and a gas outlet 158 as in the previous embodiment.

Reverting to the optimum size of an individual unit, this can be derived based on two criteria pertaining to flow velocities. In both dry dust collection units with rear louvers, and mist collectors with perforated sheet at the rear of the bed, the maximum gas velocity at the exiting face of the bed, $V_e$, has been found to be about 100 fpm. Details as to how this number is derived will be provided later. Thus, with a tubular bed of given height and diameter, the gas flow velocity, $V_t$, entering the internal gas passage is known.

$$V_t = \frac{\pi\, \phi_o h\, Ve}{\left(\pi \cdot \frac{\phi_i^2}{4}\right)}$$

or $$V_t = 400\,\frac{(\phi_i + 1)h}{\phi_i^2}$$

Where:

$\phi_i$ is the inner bed diameter;

$\phi_o$ is the outer bed diameter; and h is the height of the bed.

$V_t$ is further constrained as follows. It is desired that the gas distribute itself as uniformly as possible across the entire bed surface, but the gas entering the tube has a certain downward momentum as it enters the tube. According to fluid mechanical theory, an equivalent pressure head can be assigned to this momentum. For air at room temperature and pressure, this velocity pressure VP head is:

$$VP = \sqrt{\frac{V}{4005}}$$

(where V is in fpm and VP in inches water gauge.) Since the pressure drop across the bed is from 2 to 4 inches wg, the gas will distribute well if the velocity pressure is considerably less than 2 to 4 inches. Experimentally, it has been found that a maximum of 2000 fpm gas velocity at the internal passage entrance is the maximum allowable for good gas flow distribution. This number is justified by the simple theory proposed since VP=0.707 for this value. This constraint is important because poor gas flow distribution can lead to poor collection efficiency, localized blow-off of collected dust, localized droplet formation in drain-off type units and even localized blowout of bed granules.

Using this relationship, the bed height can be specified as related to the diameter. $V_t$=2000 fpm yields:

$$h = \frac{5\phi_i^2}{(\phi_i + 1)}$$

Optimum size is referred to lowest cost per cfm of gas flow handling capability. To pursue such an analysis, several assumptions need to be made. The most important is that equipment cost is directly proportional to equipment volume for metal fabrication. Therefore, the problem reduces to one of finding the unit size with a maximum of flow handling volume Q (cfm) per unit of equipment volume V (ft$^3$) or a maximum of $Q/V$. In the analysis, care should be taken to account for all the equipment volume, including peripheral equipment.

The fundamental parameter used is bed inside diameter $\phi_i$ (with ft as the unit of measurement). For a 6 inch deep bed (the nominal case), the outside diameter is then $\phi_o=\phi_i+1$. Surrounding the outside diameter, an air plenum is required to contain and convey the gas exiting the bed. Nine inches on the radius is allowed for this plenum. Gravel hoppers are required both above and below the active filter region. The former is simply a cylinder, the diameter of which is the bed O.D. while the height is equal to the O.D. (because gravel distributes to the bed by angle of repose from two feed points on the top of the hopper). A conical hopper is required below, the diameter of the cone base being the bed O.D., and the cone walls being inclined at 60° to the horizontal, so the cone height is $$\frac{\phi_o}{2}\sqrt{3}.$$

The ionizer insulator region is a cylinder 24 inches in diameter and 24 inches high, the three bed insulator regions are 18 inches diameter by 18 inches high. These are the same for any size tube. The sum of all the volumes is then:

$$V(\text{ft}^3) = \underbrace{\frac{\pi(\phi_i + 2.5)^2}{4} h}_{\text{Air plenum, including filter bed tube}} + \underbrace{\frac{\pi(\phi_i + 1)^3}{4}}_{\text{Upper hopper}} \times$$

$$\underbrace{\frac{1}{\sqrt{3}}\pi\left(\frac{\phi_i + 1}{2}\right)^3}_{\text{Bottom hopper}} + \underbrace{2\pi}_{\text{Charger insulators}} +$$

$$\underbrace{3\pi\frac{(1.5)^3}{4}}_{\text{Bed insulators}}\left(h = \frac{5\phi_i^2}{\phi_i + 1}\right)$$

The flow handling capability is defined by the tube inner diameter and $V_t$=2000 fpm. Then:

$$Q(\text{cfm}) = 2000\frac{\pi\phi_i^2}{4}.$$

The ratio of $Q/V$ can now be calculated as a function of $\phi_i$, and plotted.

An optimum is found to result for the range of $\phi_i$ from about 1.5 to 3 feet. For diameters below this optimum, the so-called fixed volumes (for the insulator regions) dominate the total volume, making for a large unit handling a small amount of air. For diameters above the optimum, much of the unit volume is internal to the filter bed, and not realy being utilized, again an inefficient arrangement.

To optimize gas flow distribution through the bed in the vertical direction when using a downwardly moving bed, the inventors have defined a parameter:

$$M = \frac{\left[1 - \frac{Q_g c_d \gamma_s (1-\epsilon)}{\dot{m}_s \gamma_d \epsilon}\right]^{-4/3}}{\left[1 + \frac{\frac{1}{2}\gamma_g V_t^2}{\Delta P_o}\right]}$$

where $Q_g$=Volume flow rate of gas (ft$^3$/min)
$c_d$=Dust concentration in gas (lb/ft$^3$)
$\gamma_s$=Granule mass density (lb/ft$^3$)
$\gamma_d$=Dust bulk density (lb/ft$^3$)
$\epsilon$=Clean bed fraction voids (volumetric)
$\dot{m}_s$=Granule flow rate (lb/min)
$V_t$=Velocity of gas entering internal gas passage (ft/min)
$\gamma_g$=Gas mass density (lb/ft$^3$)
$\Delta P_o$=Clean bed pressure drop at nominal face velocity (lbf/ft$^2$)

$$\left(1\ \text{lbf} = .0089\frac{\text{lb ft}}{\text{min}^2}\right)$$

The numerator of M is, for a given face velocity, the relative increase in pressure drop across the bed as the bed loads with dust as dictated by the system parameter. It is calculated based on the decrease of voidage in the bed, and resulting increase in viscous pressure loss according to classical fluid mechanics theory. The denominator is the relative increase in pressure supplied to the lower portions of the tubular filter by means of the gas inertia. Thus, when the increase in pressure required by the dustloaded lower regions of the filter is the same as the increase in pressure in these regions supplied by the gas inertia, $M \approx 1$ and flow will be relatively uniform. Deviations from $M \approx 1$ will cause flow nonuniformities. $M > 1$ concentrates flow at the upper portions of the bed while $M < 1$ concentrates flow at the lower portions. The maximum practical bounds on M are estimated to be: $0.7 < M < 1.3$.

The invention also contemplates a method and means for cleaning the bed granules. Certain filtering applications involve the collection of both liquid and solid pollutants entrained in the same gas stream. The resulting accumulation on the bed granules is accordingly a mixture of the two. This mixture does not drain (as with pure liquid pollutants) and tends to build up in the bed. As a result, the bed should be moved (as with dry pollutants) to prevent plugging, and the granules must be cleaned. Pneumatic cleaning systems suitable for dry dusts are not effective for liquid dust pollutant mixtures.

It has been found that the bed granules when coated with liquid dust pollutants can be effectively cleaned by washing with oil and then returned to the bed for reuse. Further, the solid component of the pollutant collected in the oil can be settled out, making the oil effectively reusable. The specific washing technique may be varied widely, provided the following general principles are followed.

The washing oil should be electrically insulating or, more specifically, have a bulk electrical resistivity greater than $10^6 \Omega$-m. Also, the washing oil should be sufficiently inviscid to drain from the granules in a reasonable time. The highest suitable viscosity is considered to be that of a standard motor oil. One commercially available oil, for example, which has been found to be suitable is Shell Carnea Oil.

Figure 8:
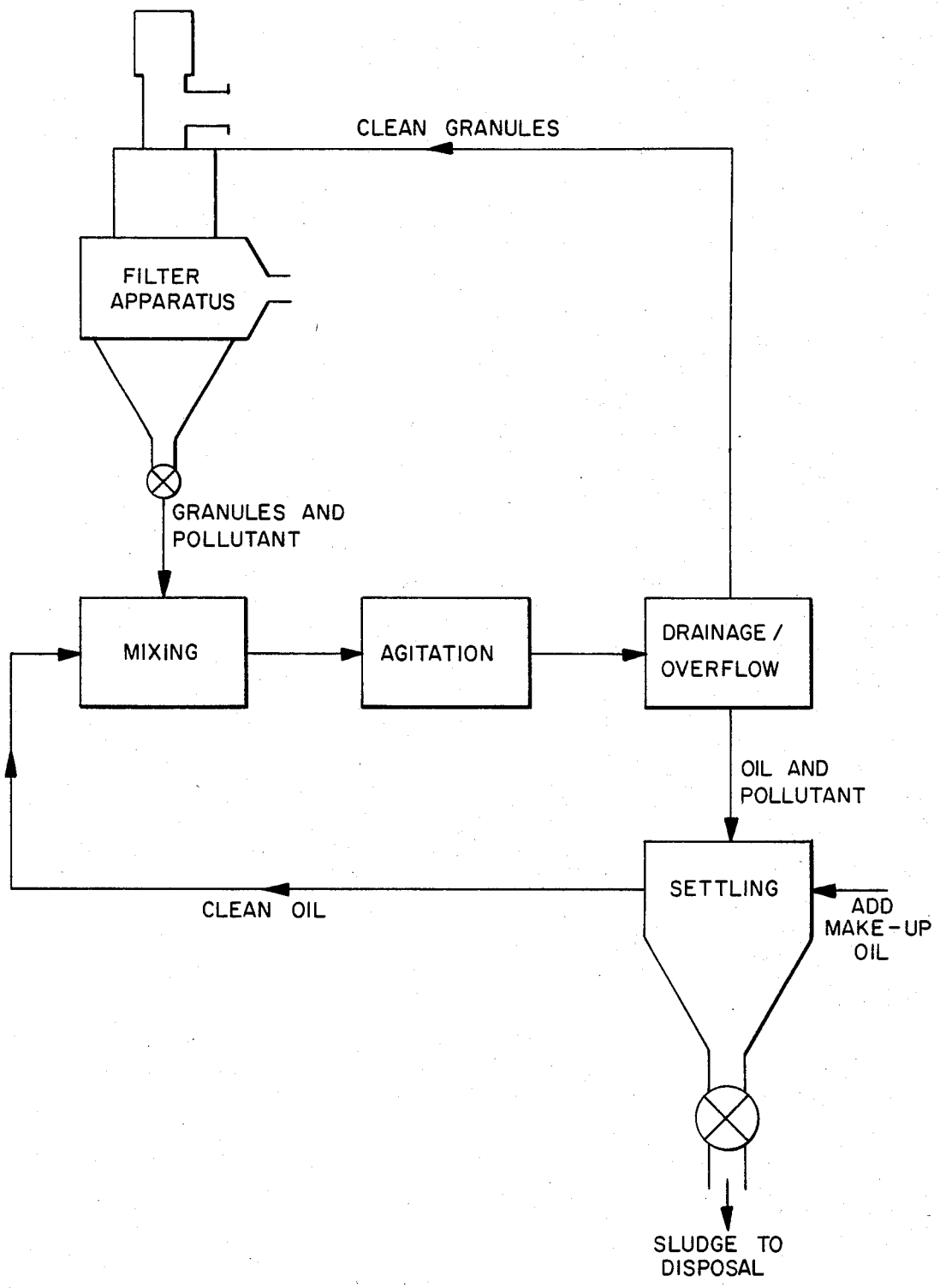
FIG. 8 is a diagram showing a cleaning system for pollutant-coated bed granules.

Several functions should be performed in the washing system, as shown for example in FIG. 8. Firstly, the oil is added to the pollutant-coated granules discharged from the electrified filter bed apparatus, which may be of a type previously described herein or in the aforementioned patent application. Clean oil should be added to the discharged gravel and thoroughly mixed therewith in a mixing stage. The quantity of clean oil should be at least five times the volume of the pollutant to be cleaned to prevent the resulting mixture from becoming too viscous. Mixing of the oil and granules may, for example, be effected in apparatus such as a screw feeder.

Second, the gravel/oil mixture should be thoroughly agitated to transfer the pollutant from the gravel to suspension in the washing oil. Agitation may, for example, be effected as a second stage in the mixing apparatus.

Third, the oil and granules may be separated in a drainage/overflow step. In general, oil may be added (in the mixing stage) in quantities in excess of that which fills the void spaces between the granules. This excess can be readily separated from the granules by an overflow/dam technique. The dirty oil in the void spaces should be drained, for example, in a suitable drainage chamber, the mixture residing in the chamber for a minimum of 10 minutes to an hour depending on the viscosity of the oil. Additionally, or alternatively, separation of the oil and granules may be accomplished continuously by centrifuging or in a vibrating screen conveyor or the like.

After separation, the cleaned granules may be returned to the filter apparatus for reuse while the oil may be transferred to apparatus such as a settling tank for separation of the suspended pollutant. It has been found that the suspended pollutant particles will settle in a relatively undisturbed tank in a period of not less than 12 hours. Clean oil can be removed from the top of the tank and reused in washing. Pollutant sludge can be removed from the base of the tank for disposal. Make-up oil may be added to account for the oil disposed in the sludge.

It will be understood that alternative mechanical systems may be employed to perform the abovedescribed granule cleaning functions. Also, various operational techniques may be used dependent on the application. For example, the granule cleaning system may be operated continuously, with continuous removal and replacement of granules to and from the filter apparatus. Alternatively, the granule cleaning system may be operated on a periodic batch basis. In the latter case, a single washing system may be used to clean granules from a plurality of filter units.

In accordance with a further feature of the invention, the bed granules may be suitably preconditioned for use in the filter apparatus. Some pollutants (such as those containing large amounts of carbon) possess electrical conductivities which interfere with the normal operation of the apparatus. As the pollutants coat the bed granules, the bed becomes electrically conducting which makes it substantially impossible to maintain a bed electrode voltage sufficient for effective pollutant collection. (The bed voltage cannot be maintained because the corresponding current required results in excessive electrical power consumption.) It has been found that this problem can be effectively alleviated by precoating the bed granules with electrically insulating oil. Then, when the conducting pollutant particles are deposited in the oil, they are held in suspension and electrically insulated from each other by the oil. There no longer exists a continuous path of the particles to conduct electricity. After some time, the oil/particle suspension is washed from the granules with the washing bed system previously described. This approach is effective when the polluted gas temperature is low enough (up to about 150° F.) such that the oil does not evaporate. Also, it is desirable when the particulate is difficult to clean from the granule (such as dry carbon particulate mixed with some oil) since the oil washing system described previously may be used effectively in conditioning the granules. The insulating oil may be the Shell Carnea Oil previously referred to. Preconditioning of the bed granules may alternatively be effected in a separate mixing step.

While several preferred embodiments of the invention have been described herein in detail, the invention is not limited thereby, and modifications may be made within the scope of the attached claims.

We claim:

1. Filter apparatus for polluted gas comprising means including inner and outer vertical cylindrical cages for retaining a tubular bed of granules in a space therebetween with the bed surrounding an internal gas passage defined by the inner cylindrical cage, said internal gas passage having an inlet for gas at its upper end, said space having an inlet for granules at its upper end and an outlet for granules at its lower end, a gas outlet plenum surrounding said cages, means including a vertical cylindrical electrode between said inner and outer cages for applying an electrical potential across the bed of granules, means including a vertical tube extending downwardly to the inlet of said internal gas passage in alignment with said inner cylindrical cage for introducing polluted gas to said internal gas passage from above and for causing the gas to flow through the bed from the inside out, and ionizer means for electrically charging pollutant particles within the gas prior to introduction to said passage, the ionizer means being restricted to said tube for creating an ionizing discharge confined within the tube above said passage.

2. Filter apparatus in accordance with claim 1, wherein the cages are constructed to support a moving bed with the bed supported by the cages for downard movement while said gas flows therethrough.

3. Filter apparatus in accordance with claim 1, wherein said ionizer means comprises successive ionizer discs substantially concentrically positioned in the tube.

4. Filter apparatus in accordance with claim 1, wherein said tube has substantially the same cross-sectional size as said internal passage.

5. Filter apparatus for polluted gas comprising means including inner and outer vertical cylindrical cages for providing a bed of granules in tubular form in a space surrounding a central passage, said central passage having an inlet for gas at its upper end, said space having an inlet for granules at its upper end and an outlet for granules at its lower end, means including a vertical cylindrical electrode between said cages for applying an electrical potential across the bed of granules, means including a gas outlet plenum surrounding said cages for passing polluted gas through the bed from said gas passage, and means for electrically charging polluted particles within the gas prior to entry of the gas into said passage so that the polluted particles are attracted to the bed, wherein said last-mentioned means comprises an ionizer having an ionizer tube extending to the inlet of said passage and through which the gas is adapted to flow before entering said passage, and at least one ionizer disc substantially concentrically located in the ionizer tube for creating a corona discharge confined within the tube, said disc including means defining a circumferential series of spaced corona discharge points, said ionizer being restricted to said tube.

6. Apparatus as defined in claim 5, wherein the means defining the discharge points comprise sharp needles carried by the disc with the needle points protruding from the edge of the disc.

7. Apparatus as defined in claim 5, wherein the tube and the passage have substantially the same cross-sectional size.

8. Apparatus as defined in claim 5, wherein the tube is adapted to be disposed vertically in use and the disc is carried by a suspension shaft substantially coaxial to the tube and adapted to supply electricity to the disc to produce said discharge.

9. Apparatus as defined in claim 8, having mounting means for the shaft including means for centering the disc in the tube.

10. Filter apparatus for polluted gas comprising means including inner and outer vertical cylindrical cages for providing a bed of granules in tubular form in a space surrounding a central passage, said central passage having an inlet for gas at its upper end, said space having an inlet for granules at its upper end and an outlet for granules at its lower end, means including a vertical cylindrical electrode between said cages for applying an electrical potential across the bed of granules, means including a gas outlet plenum surrounding said cages for passing polluted gas through the bed from said gas passage, means for electrically charging pollutant particles within the gas prior to entry of the gas into said passage so that the pollutant particles are attracted to the bed, the last-named means comprising an ionizer having an ionizer tube extending to the inlet of said passage and through which the gas is adapted to flow before entering said passage, and at least one ionizer disc substantially concentrically located in the ionizer tube for creating a corona discharge confined within the tube, said ionizer being restricted to said tube, and means for cleaning the disc and the wall of the tube in the region of the disc.

11. Apparatus as defined in claim 10, including means for rotating the disc and wherein the cleaning means inclues a nozzle fixed to the wall of the tube and adapted to clean the disc when it is rotated, another nozzle having means supporting it to rotate with the disc to clean said wall, and means supplying the nozzles with cleaning fluid.

12. Apparatus as defined in claim 11, wherein the disc is carried by a rotatable hollow shaft to which said another nozzle is attached, the apparatus including means for supplying the cleaning fluid to said another nozzle through said shaft.

13. Apparatus as defined in claim 12, including slip-ring type electrical supply means for providing electric current to the disc through said shaft for creating said corona discharge.

14. Filter apparatus for polluted gas comprising means including inner and outer vertical cylindrical cages for providing a bed of granules in tubular form in a space surrounding a central passage, said central passage having an inlet for gas at its upper end, said space having an inlet for granules at its upper end and an outlet for granules at its lower end, means including a vertical cylindrical electrode between said cages for applying an electrical potential across the bed of granuls, means including a gas outlet plenum surrounding said cages for passing polluted gas through the bed from said gas passage, and means for electrically charging pollutant particles within the gas prior to entry of the gas into said passage so that the pollutant particles are attracted to the bed, the last-named means comprising an ionizer having an ionizer tube extending to the inlet of said passage and through which the gas is adapted to flow before entering said passage, and at least one ionizer disc substantially concentrically located in the ionizer tube for creating a corona discharge confined within the tube, said tube being adapted to be disposed vertically in use and said disc being carried by a suspension shaft substantially coaxial to the tube and adapted to supply electricity to the disc to produce said discharge, said shaft having mounting means disposed in an enclosure separated from the tube by a wall through which the shaft passes, said wall having a shaft opening providing clearance around the shaft, and the apparatus in use being adapted to draw purge air from the enclosure into the tube through said clearance, said ionizer being restricted to said tube.

15. Filter apparatus for polluted gas comprising inner and outer vertical cylindrical structures including cages for retaining a tubular bed of granules in a space therebetween with the bed surrounding an internal gas passage defined by the inner cylindrical structure from which polluted gas is adapted to flow through the bed from the inside out, said internal gas passage having an inlet for gas at its upper end, said space having an inlet for granules at its upper end and an outlet for granules at its lower end, a gas outlet plenum surrounding said cages, means including a vertical cylindrical electrode between said cylindrical structures for applying an electrical potential across the bed of granules, ionizer means for electrically charging pollutant particles in the gas prior to introduction to said bed, said ionizer means including an ionizer tube formed as a vertical extension of said gas passage and means for creating a corona discharge in the tube while the gas is flowing therethrough, said ionizer means being restricted to said tube, the tube, the inner cylindrical structure, and the cylindrical electrode being joined together as a single unit that fits into the upper end of the outer cylindrical structure, and means for supporting said unit on the outer cylindrical structure.

16. Filter apparatus in accordance with claim 15, wherein said supporting means comprises an external flange on said tube.

17. Filter apparatus in accordance with claim 15, wherein said electrode is positioned relative to said inner cylindrical structure by spacers.

18. An ionizer for electrically charging pollutant particles in a gas, comprising an ionizer tube through which the gas may flow, a shaft extending along the axis of said tube, at least one ionizer disc fixed to the shaft substantially concentrially in the tube for creating a corona discharge in the tube, means for rotating the shaft and the disc, and blowdown means for cleaning built-up dust particles from the disc and from the inner wall of the tube in the region of the disc, said blowdown means comprising nozzle means fixed to the shaft and disposed to direct cleaning fluid upon said wall of the tube as the shaft rotates, and nozzle means fixed to the tube and disposed to direct cleaning fluid upon the disc as the disc rotates.

* * * * *